US009123465B2

(12) United States Patent
Moriyama

(10) Patent No.: US 9,123,465 B2
(45) Date of Patent: Sep. 1, 2015

(54) ELECTRONIC COMPONENT

(71) Applicant: MURATA MANUFACTURING CO., LTD., Kyoto (JP)

(72) Inventor: Yosuke Moriyama, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/084,361

(22) Filed: Nov. 19, 2013

(65) Prior Publication Data

US 2014/0070912 A1 Mar. 13, 2014

Related U.S. Application Data

(63) Continuation of application No. PCT/JP2012/062799, filed on May 18, 2012.

(30) Foreign Application Priority Data

Jul. 6, 2011 (JP) ..... 2011-149902

(51) Int. Cl.

| | |
|---|---|
| ***H01F 27/02*** | (2006.01) |
| ***H01F 27/255*** | (2006.01) |
| ***H01F 17/00*** | (2006.01) |
| ***H01F 17/04*** | (2006.01) |
| *H01F 27/29* | (2006.01) |

(52) U.S. Cl.

CPC ..... *H01F 27/255* (2013.01); *H01F 17/0006* (2013.01); *H01F 17/04* (2013.01); *H01F 27/02* (2013.01); *H01F 27/292* (2013.01)

(58) Field of Classification Search

CPC ..... H01F 5/00; H01F 27/00–27/30

USPC ..... 336/65, 83, 200, 232

See application file for complete search history.

(56) References Cited

U.S. PATENT DOCUMENTS

| | | | | |
|---|---|---|---|---|
| 6,580,350 | B1 * | 6/2003 | Kobayashi | 336/200 |
| 7,397,336 | B2 * | 7/2008 | Kawarai | 336/200 |

(Continued)

FOREIGN PATENT DOCUMENTS

| | | | |
|---|---|---|---|
| JP | 02-054505 | A | 2/1990 |
| JP | 2003-077728 | A | 3/2003 |
| JP | 2004-165440 | A | 6/2004 |

(Continued)

OTHER PUBLICATIONS

An Office Action; "Notification of Reasons for Refusal," issued by the Japanese Patent Office on Nov. 20, 2013, which corresponds to Japanese Patent Application No. 2013-522525 and is related to U.S. Appl. No. 14/084,361; with English language translation.

(Continued)

*Primary Examiner* — Tuyen Nguyen

(74) *Attorney, Agent, or Firm* — Studebaker & Brackett PC

(57) ABSTRACT

A laminated body is formed by stacking insulating layers to be formed into a rectangular parallelepiped shape. A linear conductor is stacked together with the insulating layers and connects end surfaces of the laminated body that are opposed to each other with respect to a first direction. Lengths of the end surfaces of the laminated body in a second direction, which is perpendicular to the stacking direction and the first direction, are equal to or smaller than the lengths of the end surfaces in the stacking direction.

18 Claims, 5 Drawing Sheets

(56) References Cited

U.S. PATENT DOCUMENTS

| | | | |
|---|---|---|---|
| 2005/0001707 | A1 | 1/2005 | Elliott et al. |
| 2009/0251268 | A1 | 10/2009 | Sato |

FOREIGN PATENT DOCUMENTS

| | | | |
|---|---|---|---|
| JP | 2004-200705 | A | 7/2004 |
| JP | 2005-259774 | A | 9/2005 |
| JP | 4307822 | B2 | 8/2009 |
| KR | 2009-0080128 | A | 7/2009 |

OTHER PUBLICATIONS

International Search Report; PCT/JP2012/062799; Aug. 21, 2012.
Written Opinion of the International Searching Authority; PCT/JP2012/062799; Aug. 21, 2012.
An Office Action; "Notice of Preliminary Rejection," issued by the Korean Patent Office on Oct. 20, 2014, which corresponds to Korean Patent Application No. 10-2013-7031951 and is related to U.S. Appl. No. 14/084,361.

* cited by examiner

ELECTRONIC COMPONENT

CROSS REFERENCE TO RELATED APPLICATIONS

The present application is a continuation of International Application No. PCT/JP2012/062799 filed on May 18, 2012, and claims priority to Japanese Patent Application No. 2011-149902 filed on Jul. 6, 2011, the contents of each of these applications being incorporated herein by reference in their entirety.

TECHNICAL FIELD

The technical field relates to an electronic component, and more particularly to an electronic component incorporating a coil.

BACKGROUND

As a conventional electronic component, for example, a multilayer inductance element disclosed by Japanese Patent No. 4,307,822 is known. FIG. 8 is an exploded perspective view of a laminated body 502 of the multilayer inductance element 500. FIG. 9 is a sectional view of the multilayer inductance element 500.

The multilayer inductance element 500 comprises a laminated body 502, a conductor pattern 504 and external electrodes (not shown). The laminated body 502 is formed by stacking a plurality of ferrite sheets 506 and a non-magnetic ceramic layer 507, and is formed into a rectangular parallelepiped shape. In the following paragraphs, surfaces of the laminated body 502 that are located at both ends with respect to the lengthwise direction of the laminated body 502 when viewed from the stacking direction are referred to as end surfaces, and surfaces of the laminated body 502 that are located at both ends with respect to the widthwise direction of the laminated body 502 when viewed from the stacking direction are referred to as side surfaces. A surface of the laminated body 502 that is located at the top in the stacking direction is referred to as a top surface, and a surface of the laminated body 502 that is located at the bottom in the stacking direction is referred to as a bottom surface.

The conductor pattern 504 is provided in the laminated body 502 and extends linearly to connect the end surfaces of the laminated body 502. The conductor pattern 504 forms a coil. The two external electrodes (not shown) are covered respectively on the both end surfaces and are physically connected respectively to the both ends of the conductor pattern 504.

FIG. 9 is a sectional view of the thus structured laminated inductance element 500, taken perpendicularly to the extending direction of the conductor pattern 504. Specifically, the non-magnetic ceramic layer 507 is arranged on both sides of the conductor pattern 504. Magnetic fluxes are difficult to pass through the non-magnetic ceramic layer 507 and therefore leak out through the side surfaces of the laminated body 502. Thereby, magnetic saturation in the laminated body 502 due to heavy concentration of magnetic fluxes can be prevented.

SUMMARY

The present disclosure provides an electronic component that can achieve a desired DC-superposing characteristic.

An embodiment of an electronic component according to the present disclosure includes a laminated body that is formed by stacking first insulating layers to be formed into a rectangular parallelepiped shape and a linear conductor that is stacked together with the first insulating layers and that connects two end surfaces of the laminated body that are opposed to each other with respect to a first direction, which is perpendicular to a stacking direction of the first insulating layers. Lengths of the end surfaces in a second direction, which is perpendicular to the stacking direction and the first direction, is equal to or smaller than lengths of the end surfaces in the stacking direction.

BRIEF DESCRIPTION OF THE DRAWINGS

This and other features of the present disclosure will be apparent from the following description with reference to the accompanying drawings, which are now briefly described.

DETAILED DESCRIPTION

Figure 9:
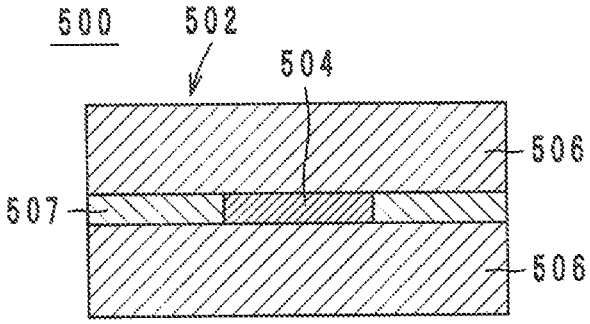
FIG. 9 PRIOR ART
FIG. 9 is a sectional view of the conventional multilayer inductance element.

The inventor realized that with the multilayer inductance element 500 disclosed by Japanese Patent No. 4,307,822, it is difficult to achieve a desired DC-superposing characteristic. More specifically, the section of the laminated body 502 shown by FIG. 9 is a horizontal rectangle, and the distances between the conductor pattern 504 and the respective side surfaces are relatively long. Therefore, magnetic fluxes flowing around the conductor pattern 504 are difficult to leak out through the side surfaces of the laminated body 502. In the multilayer inductance element 500 disclosed by Japanese Patent No. 4,307,822, therefore, magnetic saturation in the laminated body 502 may occur due to heavy concentration of magnetic fluxes. When magnetic saturation occurs, the inductance value of the multilayer inductance element 500 is lowered. Thus, the multilayer inductance element 500 is difficult to achieve a desired DC-superposing characteristic.

An electronic component according to an exemplary embodiment that can address the above drawbacks is hereinafter described.

Figure 1:
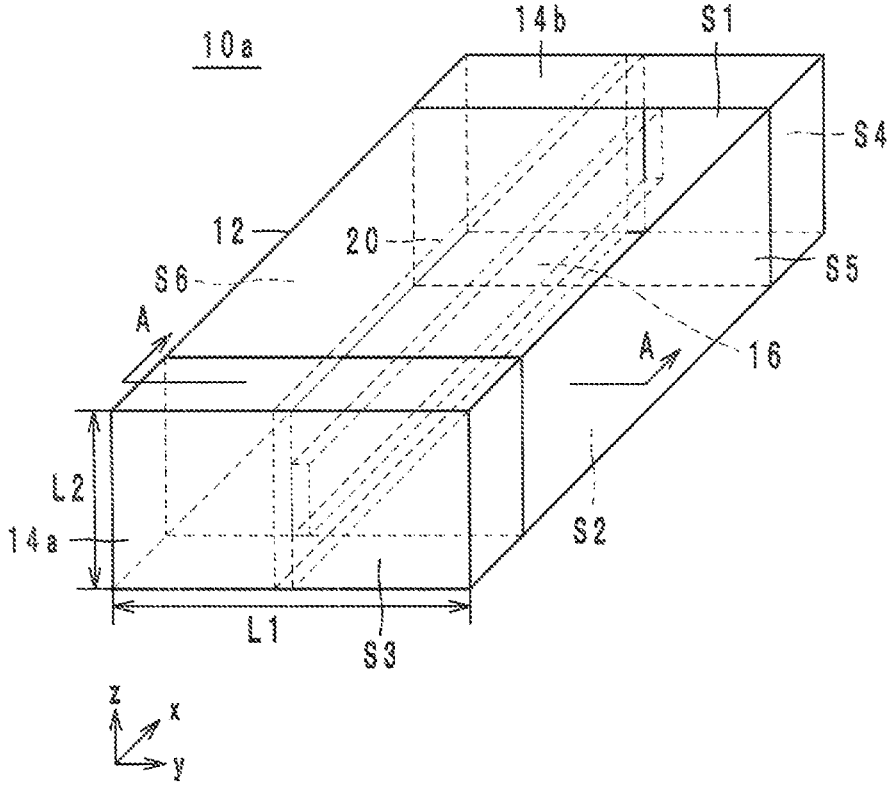
FIG. 1 is a perspective view of an electronic component according to an exemplary embodiment.
Figure 2:
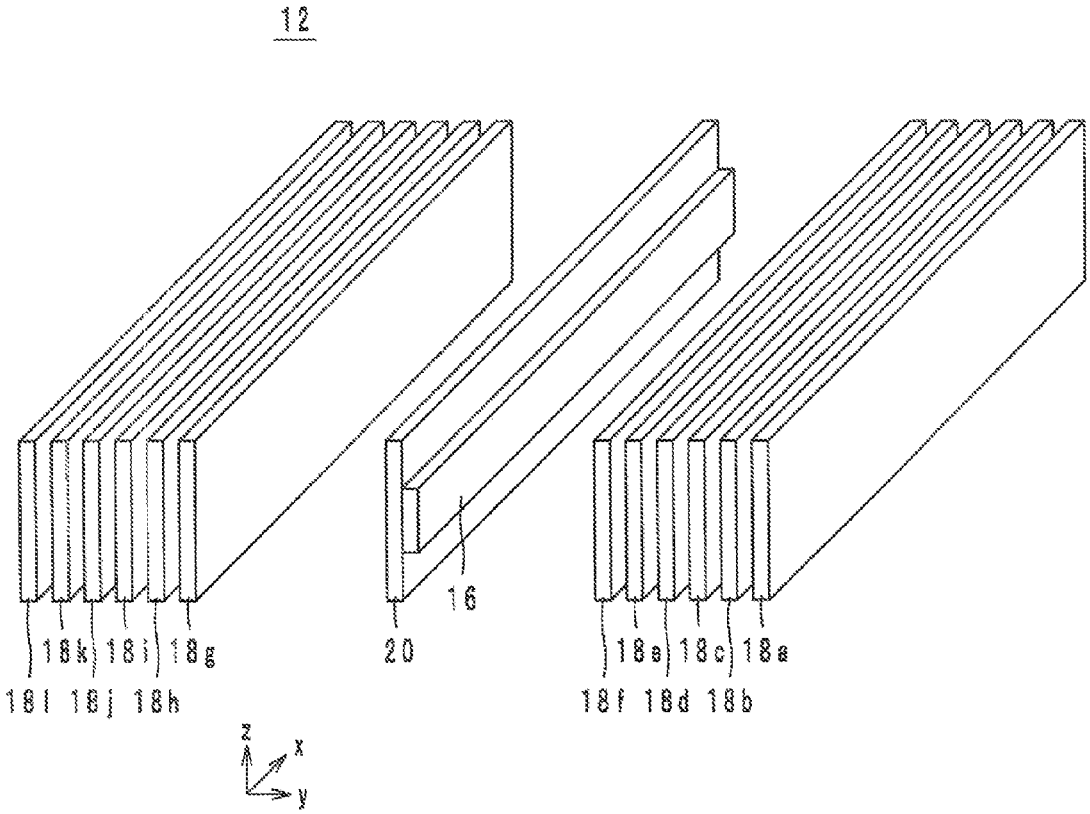
FIG. 2 is an exploded perspective view of a laminated body of the electronic component shown by FIG. 1.
Figure 3:
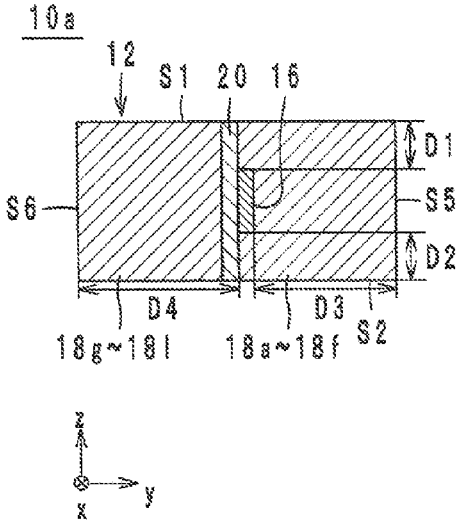
FIG. 3 is a sectional view of the electronic component shown by FIG. 1, taken along the line A-A.

Structure of the Electronic Component: the structure of an electronic component according to an embodiment is described with reference to the accompanying drawings. FIG. 1 is a perspective view of an electronic component 10*a* according to an embodiment. FIG. 2 is an exploded perspective view of a laminated body 12 of the electronic component 10*a*. FIG. 3 is a sectional view of the electronic component 10*a*, taken along the line A-A. The stacking direction, in which layers are stacked, of the laminated body 12 is defined as a y-axis direction. When the laminated body 12 is viewed from the y-axis direction, the direction in which longer sides of the laminated body 12 extend is defined as an x-axis direction, and the direction in which shorter sides of the laminated body 12 extend is defined as a z-axis direction. The x-axis direction, the y-axis direction and the z-axis direction are perpendicular to each other.

The electronic component 10*a* comprises a laminated body 12, external electrodes 14 (14*a* and 14*b*) and a conductor 16.

The laminated body 12 is in the shape of a rectangular parallelepiped, and has side surfaces S1, S2, end surfaces S3, S4, a top surface S5 and a bottom surface S6. The side surfaces S1 and S2 are surfaces of the laminated body 12 that are located at a positive side and a negative side, respectively, in the z-axis direction. The end surfaces S3 and S4 are surfaces of the laminated body 12 that are located at a negative side and a positive side, respectively, in the x-axis direction. The top surface S5 is a surface of the laminated body 12 that is located at a positive side in the y-axis direction. The bottom surfaces S6 is a surface of the laminated body 12 that is located at a negative side in the y-direction.

As shown by FIG. 2, the laminated body 12 is formed by stacking magnetic layers 18*a* to 18*f*, a non-magnetic layer 20 and magnetic layers 18*g* to 18*l* in this order from the positive side to the negative side in the y-axis direction. The magnetic layers 18 are rectangular layers of a magnetic material. The magnetic material means a material that functions as a magnetic material within a temperature range from −55 degrees C. to +125 degrees C., for example. The non-magnetic layer 20 is a rectangular layer of a non-magnetic material having a lower magnetic permeability than the magnetic layers 18 (18*a* to 18*l*). The non-magnetic material means a material that functions as a non-magnetic material within the temperature range from −55 degrees C. to +125 degrees C., for example. In the following paragraphs, with regard to each of the magnetic layers 18 and the non-magnetic layer 20, the surface at the positive side in the y-axis direction is referred to as a front side, and the surface at the negative side in the y-axis direction is referred to as a back side.

With regard to the end surfaces S3 and S4 of the laminated body 12, as shown in FIG. 1, the length L2 in the z-axis direction is equal to or shorter than the length L1 in the y-axis direction.

The conductor 16 is stacked together with the magnetic layers 18 and the non-magnetic layer 20, and thereby, the conductor 16 is embedded in the laminated body 12. The conductor 16 is typically a straight linear conductor having an inductance component. The conductor 16 connects the end surfaces S3 and S4, which are opposed to each other with respect to the x-axis direction, and the conductor 16 is exemplarily provided on the front side of the non-magnetic layer 20. The conductor 16 extends in the x-axis direction, and is formed by applying conductive paste of an Ag-based or Cu-based material on the front side of the non-magnetic layer 20.

As shown in FIG. 3, the conductor 16 is preferably located substantially in the center of the laminated body 12 with respect to the z-axis direction. In other words, the distance D1 between the conductor 16 and the side surface S1 and the distance D2 between the conductor 16 and the side surface S2 are substantially equal to each other.

Also, as shown in FIG. 2, the conductor 16 is exemplarily located substantially in the center of the laminated body 12 with respect to the y-axis direction. In other words, the distance D3 between the conductor 16 and the top surface S5 and the distance D4 between the conductor 16 and the bottom surface S6 are substantially equal to each other.

The external electrode 14*a* is provided to cover the end surface S3 of the laminated body 12, and the external electrode 14*a* is folded back to the side surfaces S1, S2, the top surface S5 and the bottom surface S6. Thereby, the external electrode 14*a* is physically connected to the end of the conductor 16 at the negative side in the x-axis direction. The external electrode 14*a* is formed, for example, by applying conductive paste on the end surface S3, thereby forming a silver electrode, and by sequential plating Sn and Ni on the silver electrode.

The external electrode 14*b* is provided to cover the end surface S4 of the laminated body 12, and the external electrode 14*b* is folded back to the side surfaces S1, S2, the top surface S5 and the bottom surface S6. Thereby, the external electrode 14*b* is physically connected to the end of the conductor 16 at the positive side in the x-axis direction. The external electrode 14*b* is formed, for example, by applying conductive paste on the end surface S4, thereby forming a silver electrode, and by sequential plating Sn and Ni on the silver electrode.

The thus structured electronic component 10*a* is used while mounted on a circuit board. When the electronic component 10*a* is mounted on a circuit board, the side surface S2 serves as a mounting surface to be opposed to the circuit board.

Manufacturing Method of the Electronic Component: an exemplary method for manufacturing the electronic component 10*a* according to the embodiment is described with reference to the accompanying drawings.

First, ceramic green sheets, which are to be used as the magnetic layers 18, are prepared. Specifically, as raw materials, diiron trioxide ($Fe_2O_3$), zinc oxide (ZnO), nickel oxide (NiO) and cupper oxide (CuO) are put into a ball mill at a predetermined ratio and are wet-blended. The thus obtained mixture is dried and then crushed, whereby powder is obtained, and the powder is calcined at approximately 800 degrees C. for approximately one hour. The calcined powder is wet-milled in a ball mill, dried and cracked, whereby ferrite ceramic powder is obtained.

A binder, such as vinyl acetate or water-soluble acrylic, a plasticizer, a wet material and a dispersant are added to the ferrite ceramic powder and mixed together in a ball mill. Thereafter, the mixture is defoamed by decompression. The thus obtained ceramic slurry is spread on a carrier sheet by a doctor blade method and is dried, whereby a ceramic green sheet is obtained. The thickness of the ceramic green sheet is 20 μm to 25 μm.

Next, a ceramic green sheet, which is to be used as the non-magnetic layer 20, is prepared. Specifically, as raw materials, diiron trioxide ($Fe_2O_3$), zinc oxide (ZnO) and cupper oxide (CuO) are put into a ball mill at a predetermined ratio and is wet-blended. The thus obtained mixture is dried and then crushed, whereby powder is obtained, and the powder is calcined at approximately 800 degrees C. for about one hour. The calcined powder is wet-milled in a ball mill, dried and cracked, whereby ferrite ceramic powder is obtained.

A binder, such as vinyl acetate or water-soluble acrylic, a plasticizer, a wet material and a dispersant are added to the ferrite ceramic powder and mixed together in a ball mill. Thereafter, the mixture is defoamed by decompression. The thus obtained ceramic slurry is spread on a carrier sheet by a doctor blade method and is dried, whereby a ceramic green sheet is obtained. The thickness of the ceramic green sheet is 20 μm to 25 μm.

On the front side of the ceramic green sheet, which is to be used as the non-magnetic layer 20, paste of a conductive material is applied by screen printing, photolithography or the like, whereby the conductor 16 is formed. The conductive paste is prepared, for example, by adding varnish and a solvent to Ag.

Next, as shown by FIG. 2, the ceramic green sheets to be used as the magnetic layers 18*a* to 18*f*, the ceramic green sheet to be used as the non-magnetic layer 20, and the ceramic green sheets to be used as the magnetic layers 18*g* to 18*l* are stacked in this order from the positive side with respect to the y-axis direction, and are provisionally pressure-bonded together. Thereby, a non-fired mother laminate is obtained. The non-fired mother laminate is permanently press-bonded by isostatic press. The isostatic press is carried out under a pressure of approximately 100 MPa and under a temperature of approximately 45 degrees C.

Next, the mother laminate is cut into pieces, whereby individual non-fired laminated bodies 12 are obtained. The non-fired laminated bodies 12 are subjected to a binder-removal treatment and to firing process. The binder-removal treatment is carried out, for example, in a hypoxic atmosphere at a temperature of approximately 850 degrees C. for about two hours. The firing process is carried out, for example, at a temperature within a range from 900 degrees C. to 930 degrees C. for about two hours and a half. Thereafter, the laminated bodies 12 are subjected to barrel polishing and chamfering.

Next, electrode paste of an Ag-based conductive material is applied on the end surfaces S3 and S4 of each of the laminated bodies 12. The electrode paste applied on the end surfaces S3 and S4 is baked at a temperature of approximately 800 degrees C. for one hour. Thereby, silver electrodes, which will turn into the external electrodes 14, are formed. Further, the silver electrodes are plated with Ni and Sn, in this order, whereby the external electrodes 14 are formed. Through the processes above, the electronic component 10*a* is completed.

Advantageous Effects: the electronic component 10*a* of the above-described structure can achieve a desired DC-superposing characteristic. In the multilayer inductance element 500 disclosed by Japanese Patent No. 4,307,822, as shown by FIG. 9, a section of the laminated body 502 is a horizontal rectangle. Therefore, the distances between the conductor pattern 504 and the respective side surfaces of the laminated body 502 are relatively long. Accordingly, magnetic fluxes flowing around the conductor pattern 504 do not leak out from the laminated body 502 through the side surfaces easily. Therefore, in the multilayer inductance element 500 disclosed by Japanese Patent No. 4,307,822, magnetic saturation may occur due to heavy concentration of magnetic fluxes in the laminated body 502. An occurrence of magnetic saturation in the laminated body 502 brings about a sharp drop in the inductance value. Thus, it is difficult to achieve a desired DC-superposing characteristic with the multilayer inductance element 500.

In the electronic component 10*a*, on the other hand, the conductor 16 is stacked together with the magnetic layers 18 and the non-magnetic layer 20, and thereby, the conductor 16 is embedded in the laminated body 12. The length L2 of the end surfaces S3 and S4 in the z-axis direction is shorter than the length L1 of the end surfaces S3 and S4 in the y-axis direction. Accordingly, when the electronic component 10*a* and the multilayer inductance element 500 that are of the same size are compared with each other, the distances D1 and D2 between the conductor 16 and the respective side surfaces S1 and S2 in the electronic component 10*a* are smaller than the distances between the conductor pattern 504 and the respective side surfaces of the laminated body 502 in the multilayer inductance element 500. Also, the distances D1 and D2 in the electronic component 10*a* are smaller than the distance between the conductive pattern 504 and the top surface of the laminated body 502 and the distance between the conductive pattern 504 and the bottom surface of the laminated body 502 in the multilayer inductance element 500. Therefore, the number of magnetic fluxes leaking through the side surfaces S1 and S2 of the electronic component 10*a* is greater than the number of magnetic fluxes leaking through the top surface, the bottom surface and the side surfaces of the multilayer inductance element 500. Accordingly, in the electronic component 10*a*, magnetic saturation is prevented, and a desired DC-superposing characteristic can be obtained.

The electronic component 10*a* has a desired DC-superposing characteristic also for the following reasons. In the electronic component 10*a*, the non-magnetic layer 20 traverses the laminated body 12 in the z-direction, and the conductor 16 is provide on the front side of the non-magnetic layer 20. Further, the length L1 of the side surfaces S3 and S4 in the y-axis direction is greater than the length L2 of the side surfaces S3 and S4 in the z-axis direction. Accordingly, the distances D1 and D2 between the conductor 16 and the respective side surfaces S1 and S2 are small. Therefore, many of the magnetic fluxes flowing around the conductor 16 leak out through the side surfaces S1 and S2 when passing through the non-magnetic layer 20. Consequently, in the electronic component 10*a*, magnetic saturation is prevented, and a desired DC-superposing characteristic can be achieved.

When the electronic component 10*a* is mounted on a circuit board, the side surface S2 serves as a mounting surface to be opposed to the circuit board. Accordingly, the main surfaces of the conductor 16 are not opposed to the circuit board, and the area where the conductor 16 is opposed to the wiring of the circuit board is small. Consequently, floating capacitance between the electronic component 10*a* and the circuit board can be suppressed.

Figure 4:
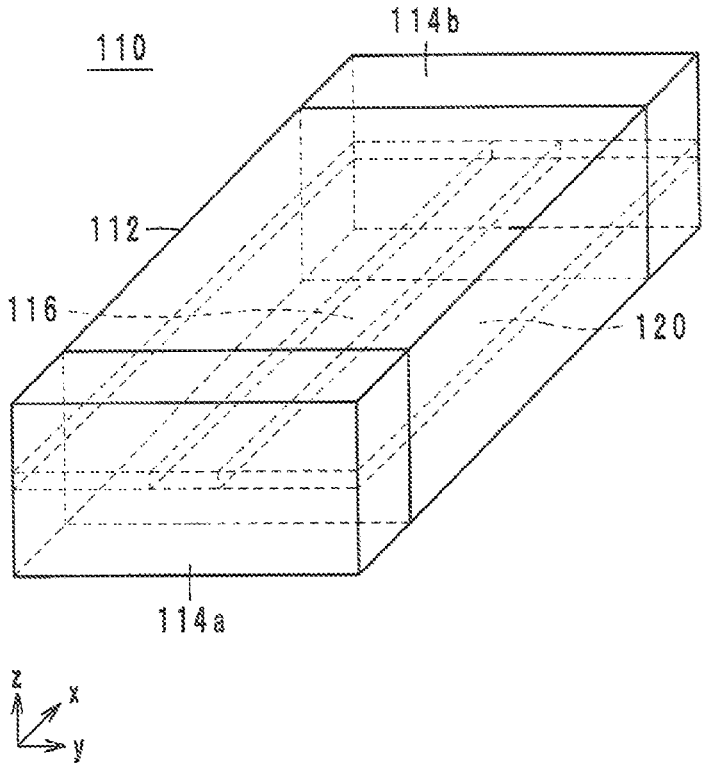
FIG. 4 is a perspective view of an electronic component of a comparative example.

Simulation: in order to prove the effects of the electronic component 10*a*, the inventors conducted a computer simulation as follows. FIG. 4 is a perspective view of an electronic component 110 of a comparative example. The parts of the electronic component 110 that are the same as those of the electronic component 10*a* are provided with reference marks obtained by adding 100 to the reference marks of the corresponding parts of the electronic component 10*a*.

The inventors fabricated a model of the electronic component 10*a* shown by FIG. 1 as a first model and a model of the electronic component 110 shown by FIG. 4 as a second model. The inductance values of each model when electric currents of 1 mA, 500 mA, 1000 mA, 3000 mA and 5000 mA were applied thereto were calculated. Further, the reduction rates in the inductance value when electric currents of 500 mA, 1000 mA, 3000 mA and 5000 mA were applied, compared with the inductance value when an electric current of 1 mA was applied, were calculated. Table 1 shows the simulation results.

TABLE 1

| | First Model | | Second Model Inductance | |
|---|---|---|---|---|
| Current (mA) | Inductance Value (nH) | Reduction Rate (%) | Value (nH) | Reduction Rate (%) |
| 1 | 6.8 | — | 10.0 | — |
| 500 | 6.7 | 2.0 | 9.8 | 2.4 |
| 1000 | 6.6 | 2.3 | 9.7 | 3.3 |
| 3000 | 5.6 | 17.6 | 6.9 | 30.9 |
| 5000 | 4.4 | 34.9 | 5.0 | 49.7 |

As shown by Table 1, the reduction rates in the inductance value of the first model while the current applied thereto was increasing were smaller than the reduction rates in the inductance value of the second model. Thus, the simulation results show that the electronic component 10*a* has a desired DC-superposing characteristic.

Figure 5:
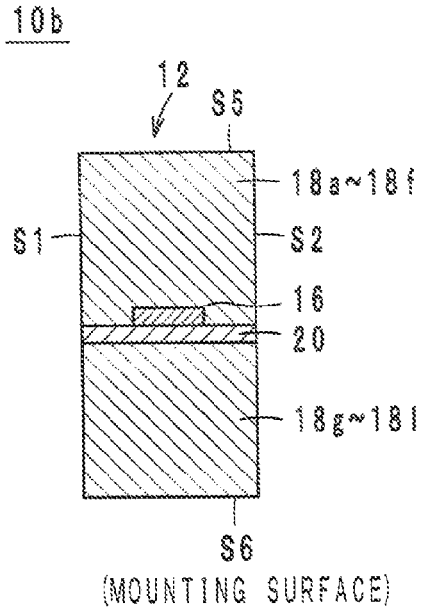
FIG. 5 is a sectional view of an electronic component according to a first exemplary modification.

First Modification Example in the following, an electronic component according to a first modification is described with reference to the accompanying drawings. FIG. 5 is a sectional view of the electronic component 10*b* according to the first modification.

The electronic component 10*b* is of the same structure as the electronic component 10*a*. The electronic component 10*b* is different from the electronic component 10*a* in the mounting surface. More specifically, when the electronic component 10*b* is mounted on a circuit board, the bottom surface S6 of the electronic component 10*b* serves as the mounting surface to be opposed to the circuit board.

The electronic component 10*b*, like the electronic component 10*a*, has a desired DC-superposing characteristic.

Figure 6:
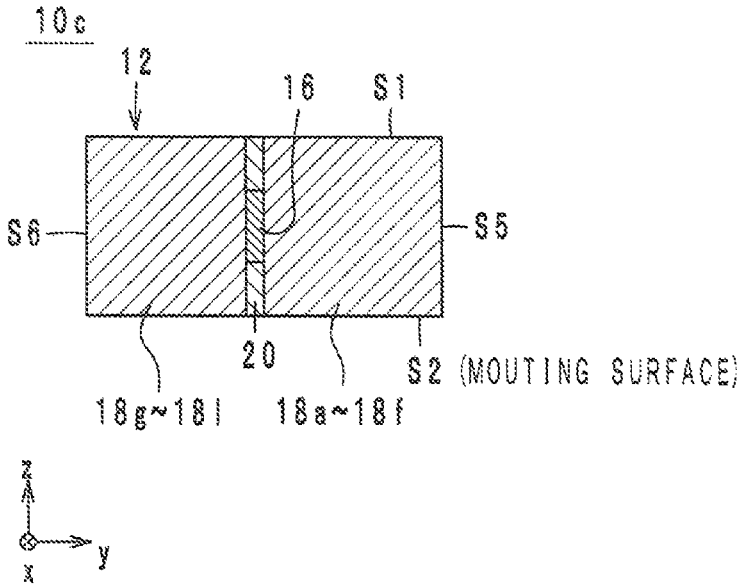
FIG. 6 is a sectional view of an electronic component according to a second exemplary modification.

Second Modification Example in the following, an electronic component according to a second modification is described with reference to the accompanying drawings. FIG. 6 is a sectional view of the electronic component 10*c* according to the second modification.

The electronic component 10*c* is different from the electronic component 10*a* in the position of the conductor 16. Specifically, in the electronic component 10*a*, the conductor 16 is provided on the front side of the non-magnetic layer 20. In the electronic component 10*c*, however, the conductor 16 is embedded in the non-magnetic layer 20. That is, the non-magnetic layer 20 exists at the positive side and at the negative side of the conductor 16 with respect to the z-axis direction. The non-magnetic layer 20 exists at neither side of the conductor 16 in the y-axis direction, and the magnetic layers 18 exist at both sides of the conductor 16 in the y-axis direction.

When the electronic component 10*c* is mounted on a circuit board, the side surface S2 of the electronic component 10*c* serves as a mounting surface to be opposed to the circuit board.

The electronic component 10*c*, like the electronic component 10*a*, has a desired DC-superposing characteristic.

Figure 7:
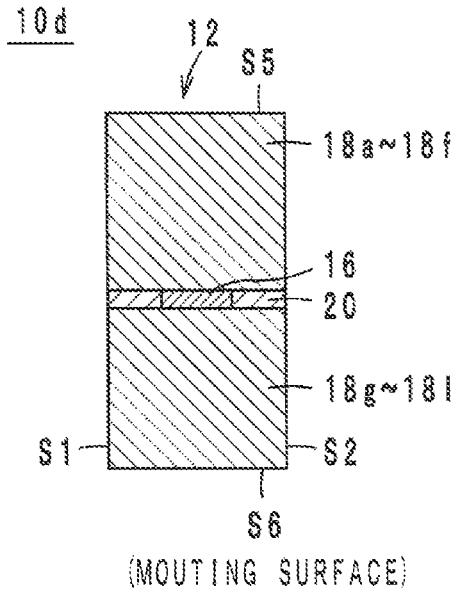
FIG. 7 is a sectional view of an electronic component according to a third exemplary modification.
Figure 8:
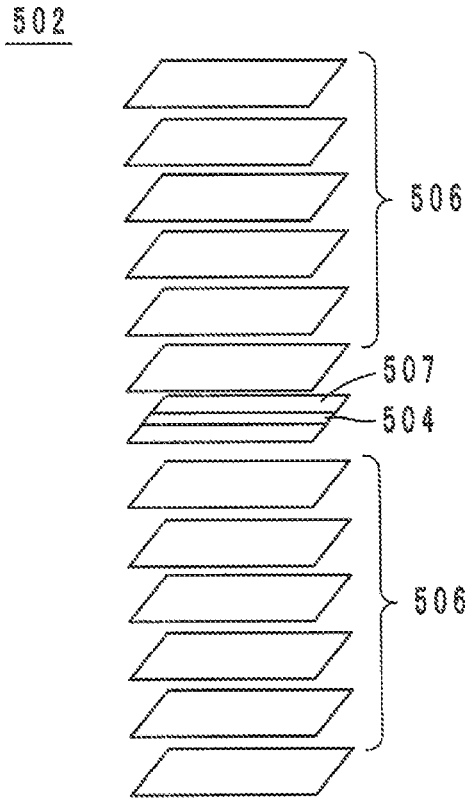
FIG. 8 PRIOR ART
FIG. 8 is an exploded perspective view of a laminated body of a conventional multilayer inductance element.

Third Modification Example in the following, an electronic component according to a third modification is described with reference to the accompanying drawings. FIG. 7 is a sectional view of the electronic component 10*d* according to the third modification.

The electronic component 10*d* is of the same structure as the electronic component 10*c*. The electronic component 10*d* is different from the electronic component 10*c* in the mounting surface. More specifically, when the electronic component 10*d* is mounted on a circuit board, the bottom surface S6 of the electronic component 10*d* serves as the mounting surface to be opposed to the circuit board.

The electronic component 10*d*, like the electronic component 10*a*, has a desired DC-superposing characteristic.

Although the present disclosure describes an exemplary embodiment and exemplary modifications thereof, it is to be noted that various changes and modifications can be made. Such changes and modifications are to be understood as being within the scope of the disclosure.

What is claimed is:

1. An electronic component comprising:

a laminated body that is formed by stacking first insulating layers to be formed into a rectangular parallelepiped shape; and a linear conductor that is stacked together with the first insulating layers and that connects two end surfaces of the laminated body that are opposed to each other with respect to a first direction, which is perpendicular to a stacking direction of the first insulating layers; wherein lengths of the end surfaces in a second direction, which is perpendicular to the stacking direction and the first direction, from a first side surface of the laminated body to an opposing second side surface of the laminated body are each equal to or smaller than lengths of the end surfaces from a third surface of the laminated body to an opposing forth surface of the laminated body in the stacking direction;

the laminated body further comprises a second insulating layer that has a smaller magnetic permeability than the first insulating layers and that is stacked together with the first insulating layers; and the linear conductor is provided on the second insulating layer.

2. An electronic component comprising:

a laminated body that is formed by stacking first insulating layers to be formed into a rectangular parallelepiped shape; and a linear conductor that is stacked together with the first insulating layers and that connects two end surfaces of the laminated body that are opposed to each other with respect to a first direction, which is perpendicular to a stacking direction of the first insulating layers; wherein lengths of the end surfaces in a second direction, which is perpendicular to the stacking direction and the first direction, from a first side surface of the laminated body to an opposing second side surface of the laminated body are each equal to or smaller than lengths of the end surfaces from a third surface of the laminated body to an opposing forth surface of the laminated body in the stacking direction;

the laminated body further comprises a second insulating layer that has a smaller magnetic permeability than the first insulating layers and that is stacked together with the first insulating layers; and the linear conductor is embedded in the second insulating layer.

3. The electronic component according to claim 1, wherein when the electronic component is mounted on a circuit board, a side surface that is located at an end with respect to the second direction serves as a mounting surface to be opposed to the circuit board.

4. The electronic component according to claim 1, wherein when the electronic component is mounted on a circuit board, a bottom surface that is located at an end with respect to the stacking direction serves as a mounting surface to be opposed to the circuit board.

5. The electronic component according to claim 1, wherein a distance between the linear conductor and a side surface that is located at an end of the laminated body with respect to the second direction is substantially equal to a distance between the linear conductor and another side surface that is located at another end of the laminated body with respect to the second direction.

6. The electronic component according to claim 1, wherein a distance between the linear conductor and a bottom surface that is located at an end of the laminated body with respect to the stacking direction is substantially equal to a distance between the linear conductor and a top surface that is located at another end of the laminated body with respect to the stacking direction.

7. The electronic component according to claim 1, further comprising:

a first external electrode and a second external electrode that are provided respectively on the two end surfaces of the laminated body and that are connected respectively to both ends of the linear conductor.

8. The electronic component according to claim 1, wherein, the linear conductor has a thickness in the stacking direction smaller than a width in the second direction.

9. The electronic component according to claim 1, wherein, the linear conductor has an inductance component.

10. The electronic component according to claim 1, wherein, the third surface is a top surface and the opposing fourth surface is an opposing bottom surface.

11. The electronic component according to claim 2, wherein when the electronic component is mounted on a circuit board, a side surface that is located at an end with respect to the second direction serves as a mounting surface to be opposed to the circuit board.

12. The electronic component according to claim 2, wherein when the electronic component is mounted on a circuit board, a bottom surface that is located at an end with respect to the stacking direction serves as a mounting surface to be opposed to the circuit board.

13. The electronic component according to claim 2, wherein a distance between the linear conductor and a side surface that is located at an end of the laminated body with respect to the second direction is substantially equal to a distance between the linear conductor and another side surface that is located at another end of the laminated body with respect to the second direction.

14. The electronic component according to claim 2, wherein a distance between the linear conductor and a bottom surface that is located at an end of the laminated body with respect to the stacking direction is substantially equal to a distance between the linear conductor and a top surface that is located at another end of the laminated body with respect to the stacking direction.

15. The electronic component according to claim 2, further comprising:

a first external electrode and a second external electrode that are provided respectively on the two end surfaces of the laminated body and that are connected respectively to both ends of the linear conductor.

16. The electronic component according to claim 2, wherein, the linear conductor has a thickness in the stacking direction smaller than a width in the second direction.

17. The electronic component according to claim 2, wherein, the linear conductor has an inductance component.

18. The electronic component according to claim 2, wherein, the third surface is a top surface and the opposing fourth surface is an opposing bottom surface.

* * * * *